US007503861B2

(12) United States Patent
Swiszcz et al.

(10) Patent No.: US 7,503,861 B2
(45) Date of Patent: Mar. 17, 2009

(54) SPORTSBALL AND METHOD OF MANUFACTURING SAME

(75) Inventors: Louis Swiszcz, Chicopee, MA (US); Ronald P. Laliberty, Dudley, MA (US)

(73) Assignee: Russell Asset Management, Inc., Wilmington, DE (US)

( * ) Notice: Subject to any disclaimer, the term of this patent is extended or adjusted under 35 U.S.C. 154(b) by 11 days.

(21) Appl. No.: 11/033,069

(22) Filed: Jan. 10, 2005

(65) Prior Publication Data

US 2005/0153803 A1 Jul. 14, 2005

Related U.S. Application Data

(60) Provisional application No. 60/535,351, filed on Jan. 9, 2004.

(51) Int. Cl.
*A63B 41/08* (2006.01)

(52) U.S. Cl. ..... 473/596; 473/603; 473/604

(58) Field of Classification Search ..... 473/603, 473/604, 596, 597, 599, 605, 607, 609
See application file for complete search history.

(56) References Cited

U.S. PATENT DOCUMENTS 5,427,372 A * 6/1995 Ratner et al. ..... 156/147
5,967,917 A 10/1999 Feeney et al.
6,022,283 A * 2/2000 Schindler et al. ..... 473/605
6,200,239 B1 3/2001 Kennedy, III et al.
6,206,795 B1 * 3/2001 Ou ..... 473/599
D446,267 S 8/2001 Feeney et al.
6,283,881 B1 9/2001 Feeney
6,287,225 B1 9/2001 Touhey et al.
6,406,389 B1 6/2002 Feeney et al.
6,409,618 B1 6/2002 Touhey et al.
6,422,960 B1 7/2002 Touhey et al.
6,422,961 B1 7/2002 Feeney
6,450,906 B1 9/2002 Touhey et al.
6,491,595 B1 12/2002 Feeney et al.
7,029,407 B2 * 4/2006 Lee et al. ..... 473/597

OTHER PUBLICATIONS

International Search Report dated Aug. 17, 2006.

* cited by examiner

*Primary Examiner*—Steven Wong
(74) *Attorney, Agent, or Firm*—Richard M. Klein; Fay Sharpe LLP

(57) ABSTRACT

The present development is directed to sportsballs or gameballs and to methods for producing the same. More particularly, the disclosure is directed to inflatable sportsballs or gameballs, such as basketballs, having a laminated construction, and to process for fabricating the same.

17 Claims, 7 Drawing Sheets

SPORTSBALL AND METHOD OF MANUFACTURING SAME

PRIORITY INFORMATION

This application claims the benefit of the filing date of U.S. Provisional Application Ser. No. 60/535,351, filed Jan. 9, 2004, incorporated entirely herein by reference.

BACKGROUND

The present disclosure relates generally to the field of sportsballs or gameballs. More particularly, the disclosure is directed to inflatable sportsballs or gameballs, such as basketballs, having improved grip, feel and other characteristics, and the methods for producing the same.

Inflatable sportsballs can be produced by several different processes. A large number of high quality basketballs feature laminated construction. These basketballs are comprised of a multi-layer structure which includes a generally spherical interior air bladder which is wound with monofilament strands to create a winding layer overlying the air bladder. A polymeric carcass is then formed, or molded, over the winding layer.

The carcass is of substantially uniform thickness defining a spherical outer surface with a carcass circumference. A plurality of ribs project outwardly from, and extend around the outer surface of the carcass. Typically, the ribs are raised about 0.75-1.50 mm above surface of the carcass.

The carcass area between the ribs defines a plurality of separated surface areas. Generally, the carcass is divided into eight (8) surface areas in simulation of the eight sewn together panels of a traditional leather-covered basketball. Panels of material are then laminated onto the outer surface of the carcass in the separated surface areas. The thickness of the panels is typically greater than the thickness of the ribs, so that the ribs, while projecting above the carcass surface, are slightly recessed below the exterior surface of the panels. The edges of the panels may be beveled or "skived" so that the panel edges will be flush with the projecting carcass rib when laminated. When finished, the laminated basketball has a generally spherical shape, with each carcass rib and opposing skived panel edges defining a panel seam or channel area.

In the construction of laminated basketballs such as those noted above, each rib of the channel area of the ball is generally constructed of a polymer such as rubber, and is connected to each panel of the ball. Each panel is generally constructed of a single material, such as leather (natural or synthetic), rubber (natural or synthetic), polyvinyl chloride (PVC), or polyurethane (PU). Optionally, a padded interior layer can be added under the exterior panel to improve shock resistance, etc. However, this additional layer is sometimes subject to delamination. Additionally, it is important to note that the exterior surface of each panel of a typical ball consists of only one type of material. This results in a ball exhibiting generally uniform characteristics, such as grip, feel, hardness/softness, slip resistance, resilience, tackiness, compressibility, moisture resistance, abrasion resistance, scuff, durability, etc. However, in certain circumstances, it is desirous to have a ball with panels and/or channel seam areas exhibiting non-uniform or different characteristics.

BRIEF DESCRIPTION OF THE DISCLOSURE

Disclosed herein are new and useful inflatable basketballs or other sportsballs and methods of manufacturing same. In one embodiment, a sportsball is provided comprising an inflatable bladder, a winding thread layer surrounding the bladder, and a carcass having an inner face adjacent said winding thread layer and an outer face. The outer face of the carcass has a plurality of curvilinearly extending ribs each having sides and an exteriorly projecting face, with the ribs defining a plurality of separated panel areas. Also included in the sportsball are a plurality of external cover panels, each affixed to the outer face of the carcass in one of the separated panel areas defined by the ribs. Each panel is comprised of two or more exterior panel portions comprising materials having different characteristics. The resulting ball has a cover exhibiting non-uniform or variable properties.

In an additional embodiment, the disclosure involves utilizing two or more different types of materials in various sizes, shapes and configurations to form portions of each external cover panel of a sportsball. This results in a ball exhibiting, in part, variable grip and feel properties with good performance and playability.

In another embodiment, a basketball of laminated construction is provided having external cover panels and/or channel areas fabricated out of two or more different types of materials. Such a basketball produces enhanced controllability compared to traditional laminated basketballs.

In still another embodiment, the disclosure also includes inflatable, laminated basketballs having a molded carcass comprised of an enhanced rib area or channel portion. Each rib has molded side members for intersecting the panels of the ball. The side members taper into the center of the rib and have a pebbled surface. When different types of materials are utilized to form the external cover panels of the ball, the resulting ball exhibits a unique variable grip or feel and, preferably has an aesthetically pleasing appearance. The ball is also easier for players to handle and control. Additionally, the ball exhibits good strength and durability.

In a further embodiment of the present disclosure, a sportsball is formed by connecting the molded ribs of the channel portions to the external cover panels, which panels are constructed from panel portions comprising two or more different materials, such as polyvinyl chloride (PVC), polyurethane (PU), rubber, micro-fiber composite or synthetic composite material. Alternatively, the panel portions can be constructed out of similar materials, each however having different desired characteristics, such as softness, tackiness, resilience, compression, moisture resistance, etc. Optionally, the channels and panels may be alternated in a pattern, such as a uniform pattern, to create a unique cover for the ball. For example, utilizing various combinations of materials with different characteristics, a sportsball can be produced having areas exhibiting a softer feel which tends to improve grip of the ball and overall playability.

Also disclosed in another embodiment is a manufacturing process for producing a laminated sportsball, such as a basketball, including the use and selection of a combination of multiple materials, as mentioned above, i.e., PVC, PU, rubber, micro-fiber composite or other synthetic composite materials to produce portions of the paneled exterior surfaces of the ball. The panels are produced by joining together materials of different compositions, in various sizes, shapes and configurations. This results in a ball exhibiting similar characteristics as a conventional ball with improved grip and feel properties, including under conditions of elevated moisture such as those caused by player perspiration, etc.

In still another embodiment, the present disclosure relates to an inflatable, laminated basketball comprising a spherical interior air bladder which is wound over with monofilament reinforcement strands. A carcass is formed over the wound bladder. The formed carcass includes a plurality of ribs extending curvilinearly around the carcass and extending above the outer surface of the carcass. The carcass outer surface between the ribs defines a plurality of separate panel areas. The carcass is of substantially equal thickness in the panel areas. The carcass thickness in the ribs is greater than the carcass thickness in the panel areas. Optionally, the carcass thickness in the area transversely disposed from the ribs gradually changes from a lesser thickness at the rib to a greater thickness in the panel area. The exterior face of the rib is above the carcass circumference.

In this embodiment, cover panels comprising multiple types of different materials are bonded or laminated in the panel areas. The panels are bounded by the ribs formed in the carcass. The panels are skived and/or follow the tapered surface of the channel, so that the skived panel edges are substantially flush with the exterior face of the rib. The resulting basketball will define novel panel and/or channel areas which exhibit enhanced gripability and feel, as well as other characteristics, when compared to traditional laminated basketballs.

There has thus been outlined, rather broadly, some of the more important features of the sportsball disclosed herein in order that the detailed description thereof that follows may be better understood. There are, of course, additional features of the disclosure that will be described hereinafter and which will form the subject matter of the claims appended hereto.

In this respect, before explaining at least one embodiment of the sportsball disclosed herein in detail, it is to be understood that the disclosure is not limited in this application to the details of construction and to the arrangements of the components set forth in the following description or illustrated in the drawings. The disclosed sportsball is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present development. It is important, therefore, that the claims be regarded as including such equivalent constructions insofar as they do not depart from the spirit and scope of the disclosure.

BRIEF DESCRIPTION OF THE DRAWINGS

Other objects and advantages of the development disclosed herein will be evident to one of ordinary skill in the art from the following description and Figures, in which.

DETAILED DESCRIPTION

Figure 1:
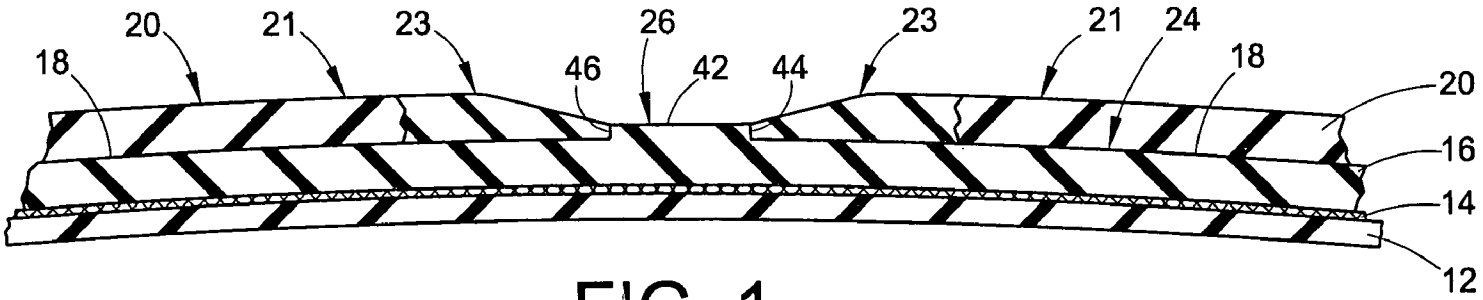
FIG. 1 is a cross-sectional view of a broken away portion of an embodiment of the laminated basketball disclosed herein.
Figure 2:
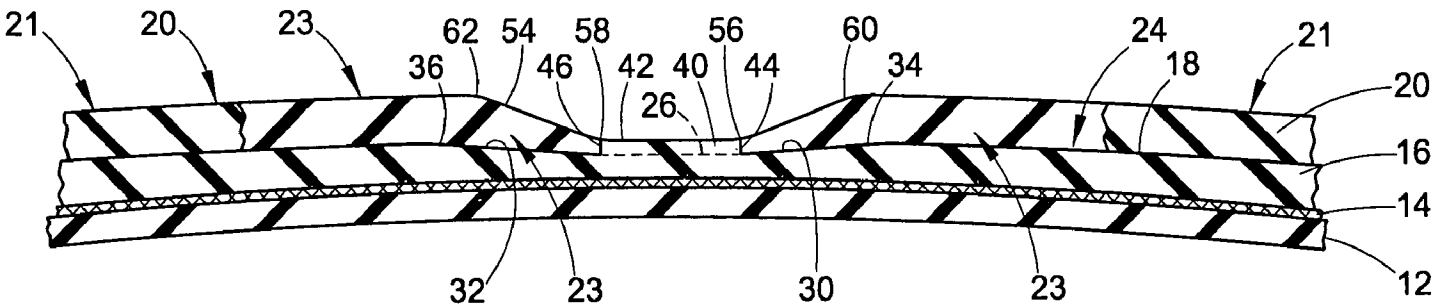
FIG. 2 is a cross-sectional view of a broken away portion of an embodiment of a laminated basketball having a tapered carcass and panel portions of variable construction.

A sportsball, such as a basketball, constructed in accordance with the principles of one embodiment of the present development, generally indicated by the numeral 10, can readily be understood with reference to the drawings, wherein the numerals represent like parts. Such a basketball is made up generally of four major components: an interior air bladder 12, a layer 14 of reinforcement strands wound over the bladder, a carcass 16 formed over the wound layer and defining panel areas 18 and ribs 26, with exterior or "skin" panels 20 secured in the panel areas 18 of the carcass 16. See FIGS. 1 and 2.

More specifically, the bladder 12 is formed spherically and is adapted to be inflated with air. The bladder 12, when properly inflated, provides the primary resilience for the finished basketball 10. Such air bladders are usually formed of butyl rubber or butyl and natural rubber compounds and are fitted with a valve stem (not shown) for introducing air into the ball to inflate and pressurize the structure. The preferred material for the bladder is principally synthetic butyl rubber, but may include natural rubber, such as about 15% natural rubber.

Outwardly disposed of the interior air bladder is a layer 14 comprising monofilament polymeric strands, preferably of nylon or polyester. The strands are optionally coated with an adhesive (not shown), preferably a rubber cement, to ensure retention of the strands on the bladder. The winding layer 14 adds dimensional stability to the bladder 12 and ball 10, restrains outward expansion when inflated, and also reduces outward pressure on the carcass 16.

The next exterior most layer of the basketball 10 is an elastomer carcass 16. The carcass is preferably fabricated from a polymer composition molded over the wound bladder. Rubber (natural and/or synthetic) is preferred for improved rebound and durability. The rubber is placed in a carcass mold and cured under conventional temperatures, pressures, etc. The resulting molded carcass 16 has a substantially spherical outer surface 24 defining a carcass circumference. A plurality of curvilinearly extending ribs 26 are projected above the carcass circumference.

The exterior face 42 of the extending rib 26 is above the substantially spherical outer surface. The outwardly extending rib 26 also has lateral, generally vertical sides 44 and 46. It should be noted that while the carcass 16 and ribs 26 are described separately for clarity, in practice the carcass 16 will be formed as an integral portion including panel areas 18 and ribs 26 around the wound layer 14. The carcass surface 24 between the ribs 26 defines the plurality of panel areas 18. While not shown, a rib 26 having non-linear vertical rib sides, non-linear rib faces or radiused shoulders is also fully encompassed by this development.

The carcass 16 has a thickness in the range of about 0.5 mm to about 1.5 mm and a preferred range of about 0.8 mm to about 1.2 mm over the majority of the panel areas 18. The rib 26 has a thickness in the range of about 0.75 mm to about 1.50 mm. The carcass 16 may also comprise an integral cellular portion (not shown) adjacent the winding layer 14.

The preferred material for the carcass 16 is a rubber compound (i.e., polyisoprene, polybutadiene, etc.). The carcass 16 is preferably formed of two hemispheres separated at an equator line, which are preferably molded over the winding layer 14. The molding of the carcass hemispheres onto the winding layer forms a unitary, relatively seamless carcass 16 comprising ribs 26, panel areas 18 and also causes the carcass material to flow into and around the strands of the winding layer 14 for a secure mechanical bond.

Figure 3:
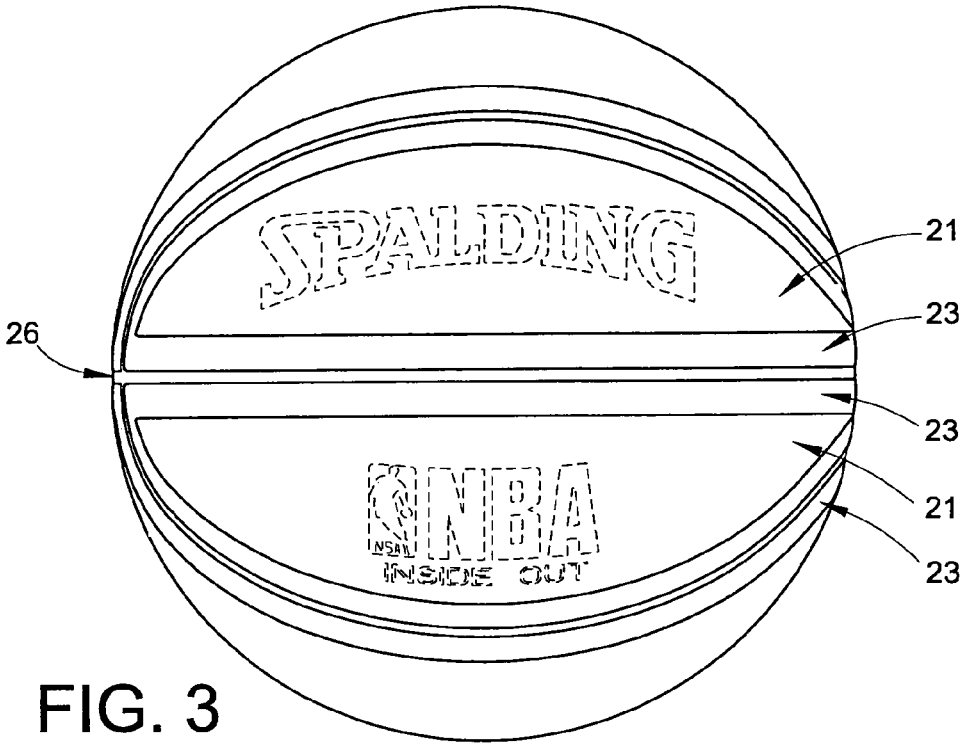
FIGS. 3-8 are plan views of one embodiment of the laminated basketball disclosed herein.
Figure 4:
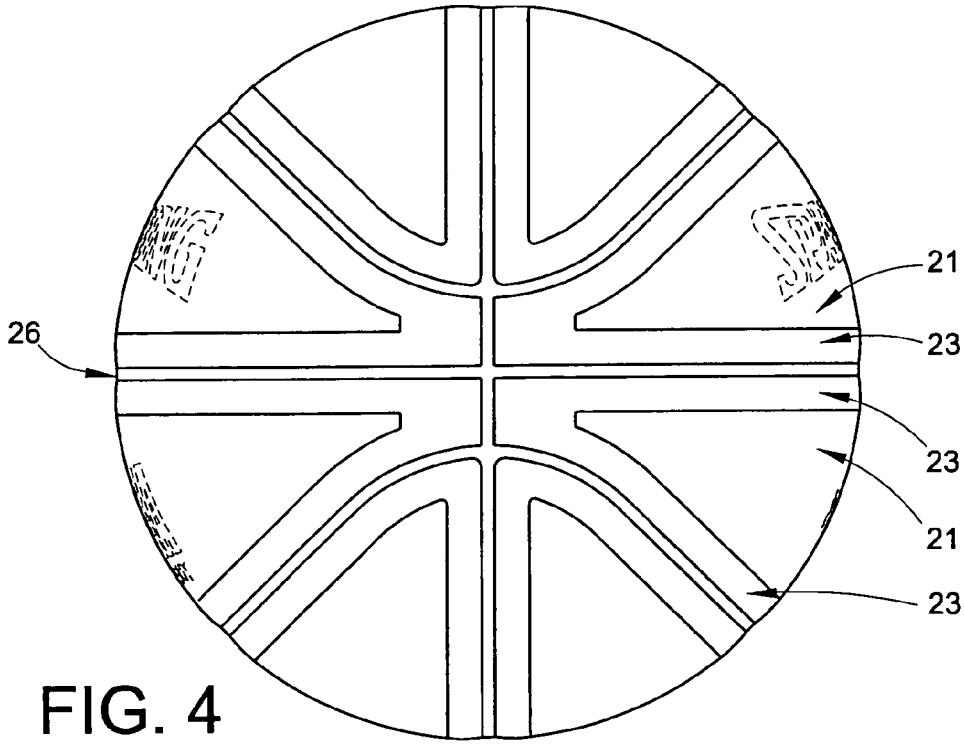
Figure 5:
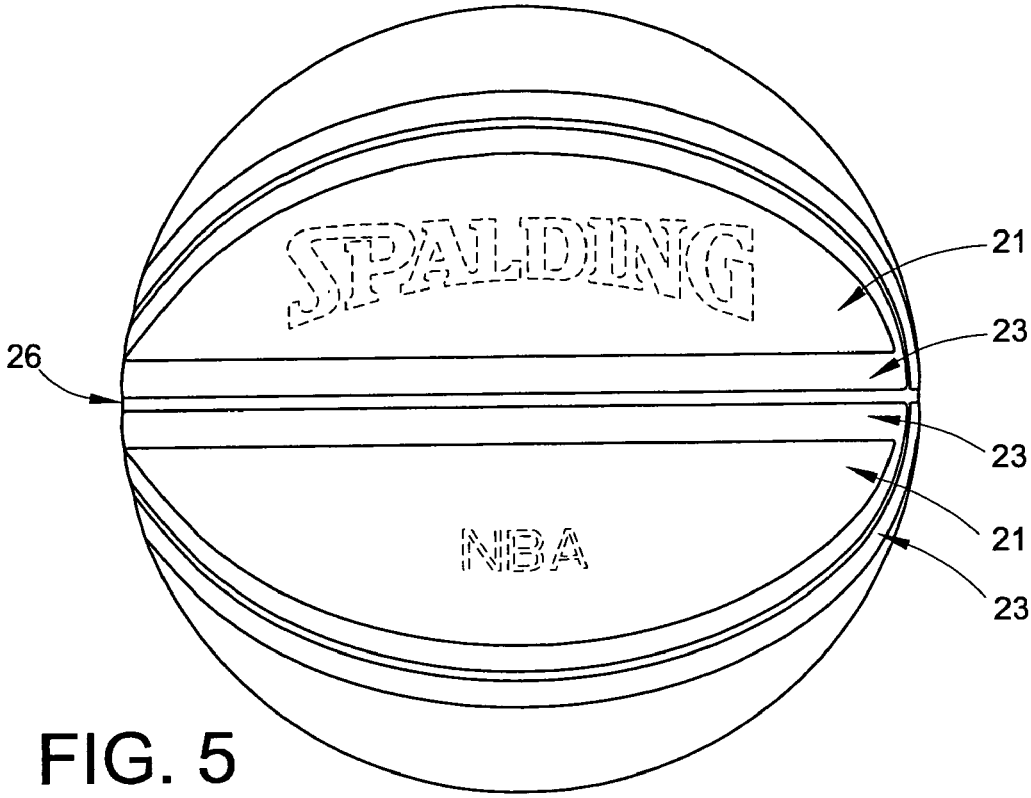
Figure 6:
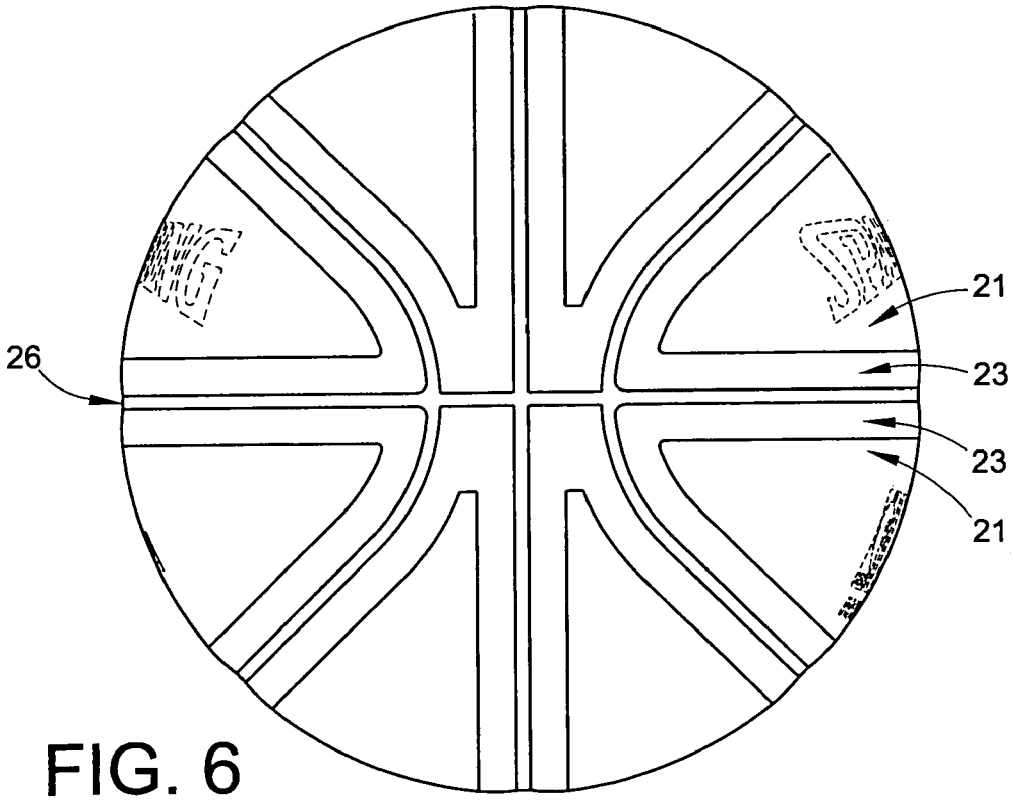
Figure 7:
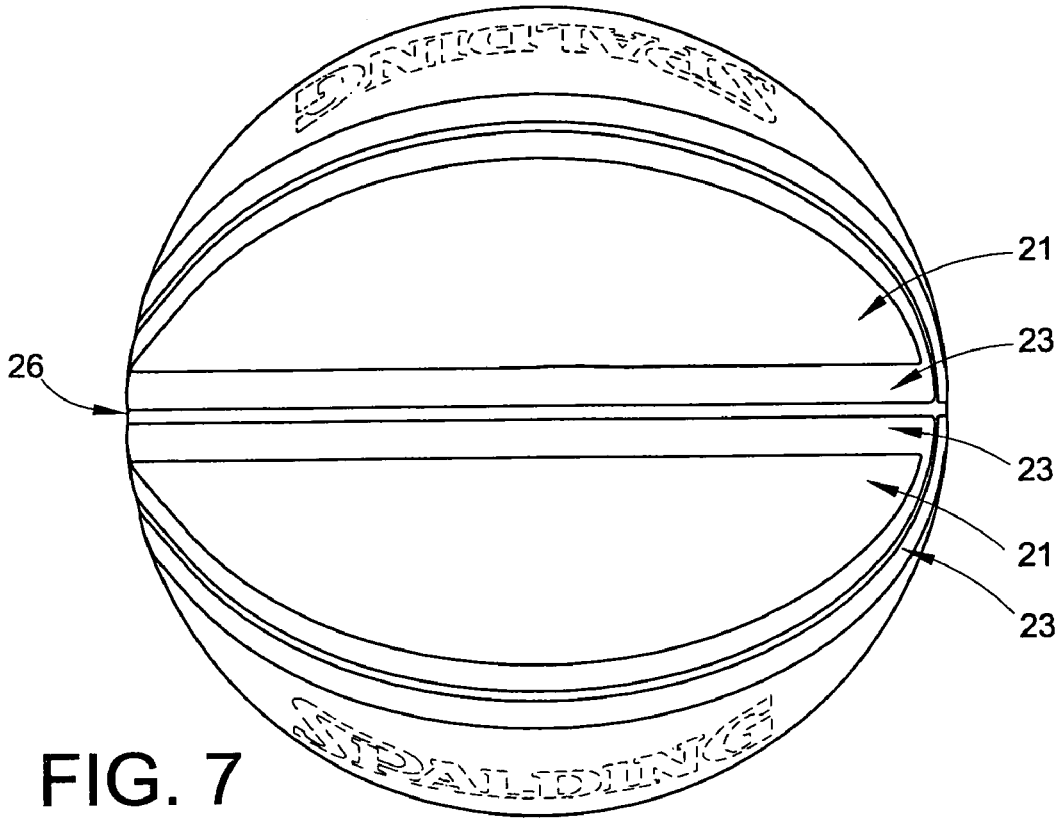
Figure 8:
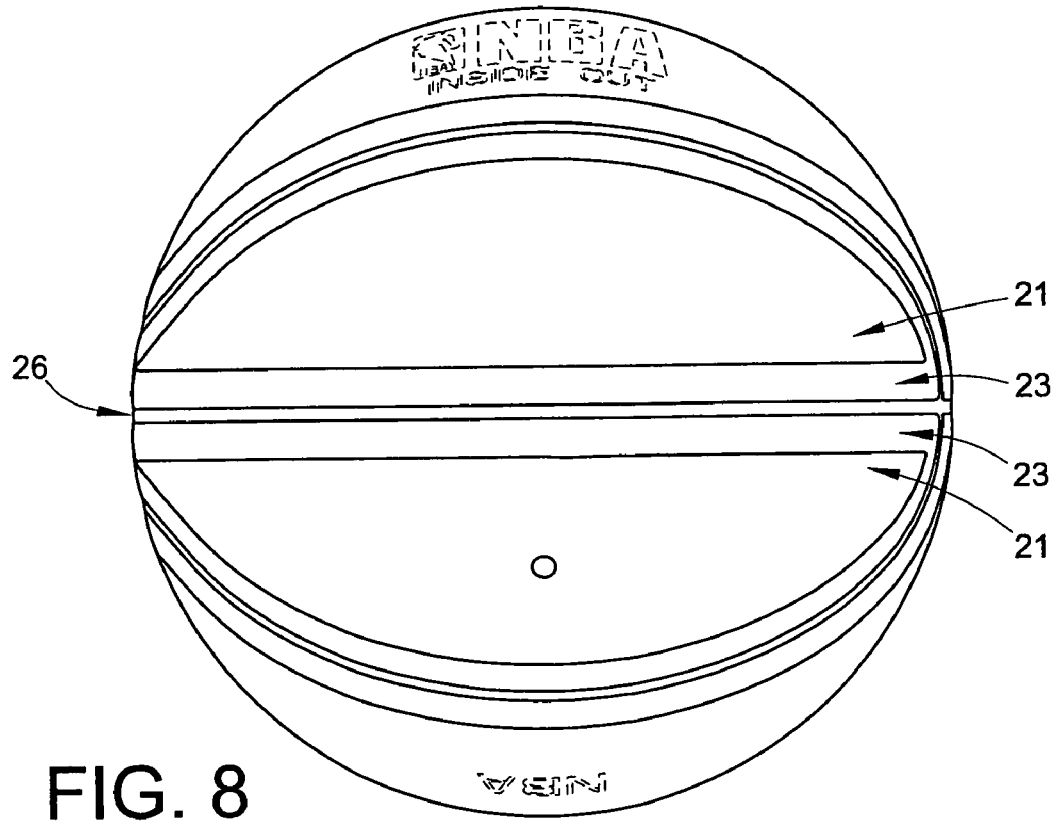
Figure 9:
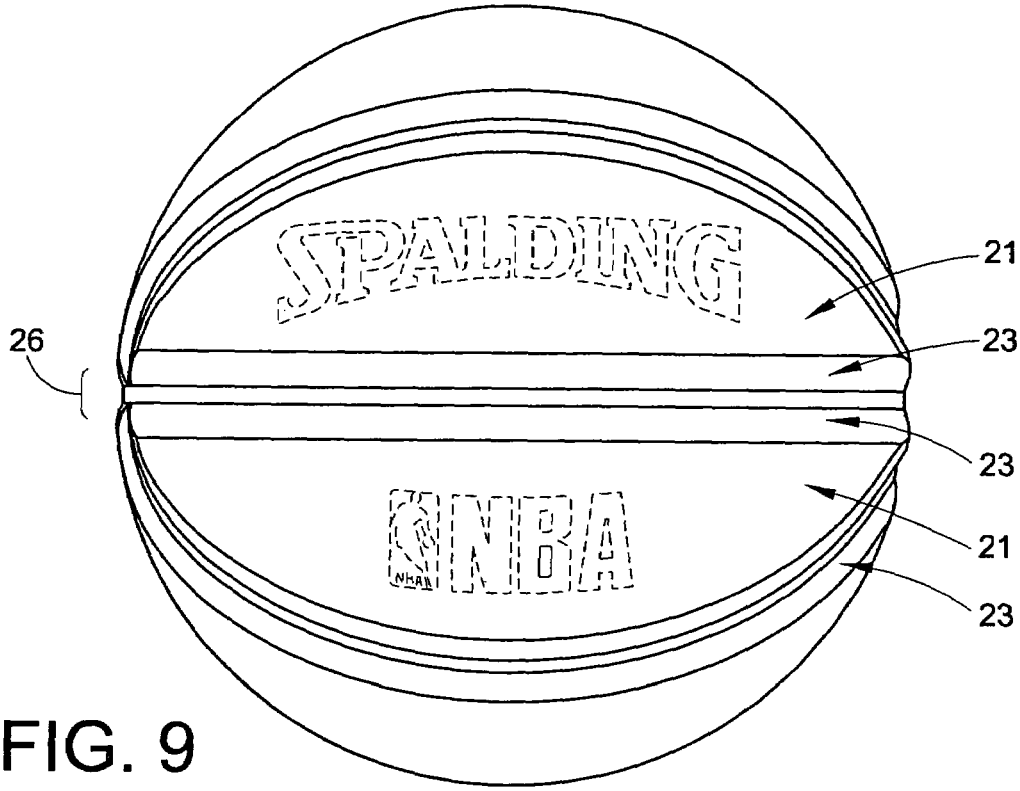
FIGS. 9-14 are plan views of another embodiment of such a laminated basketball.
Figure 10:
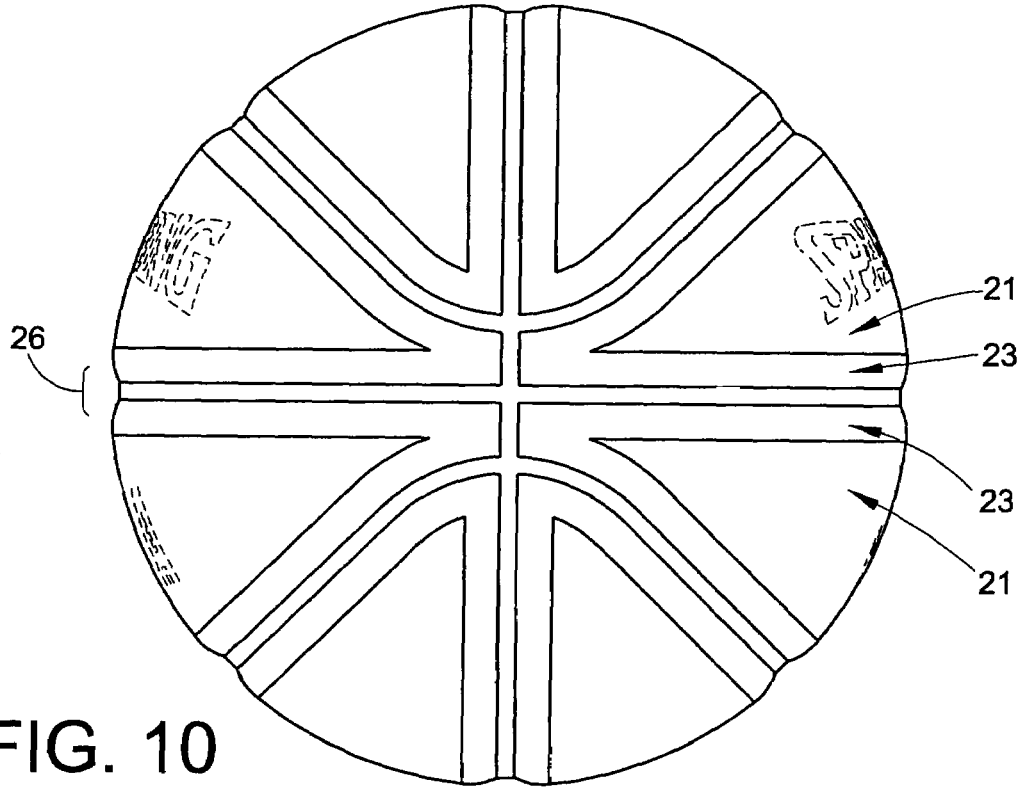
Figure 11:
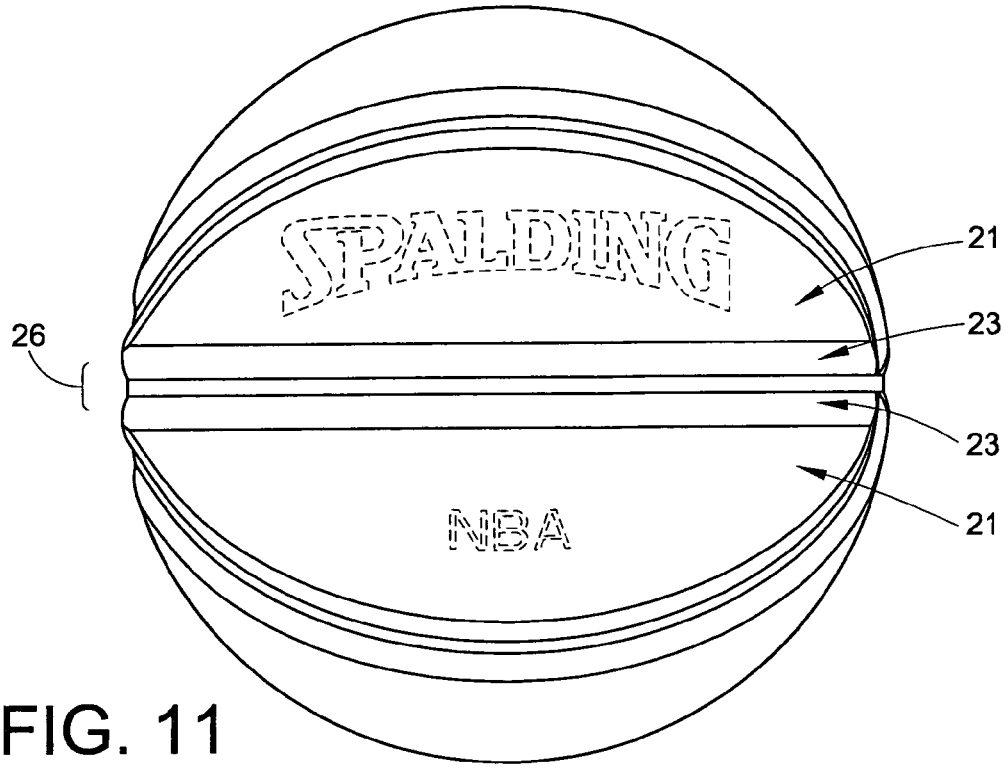
Figure 12:
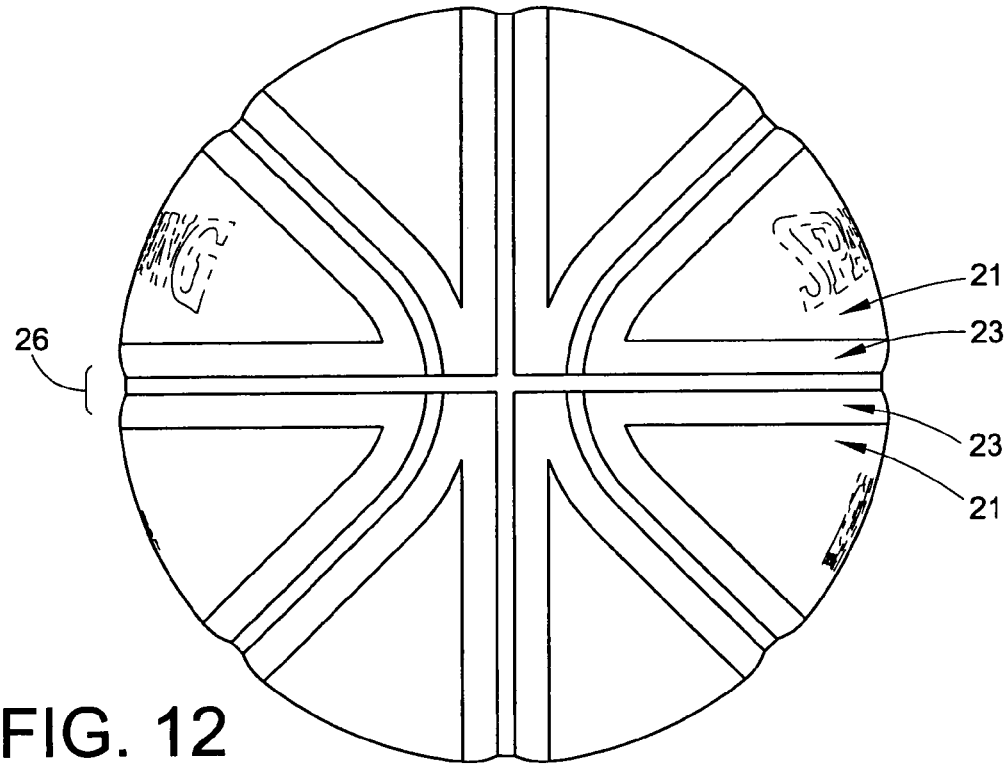
Figure 13:
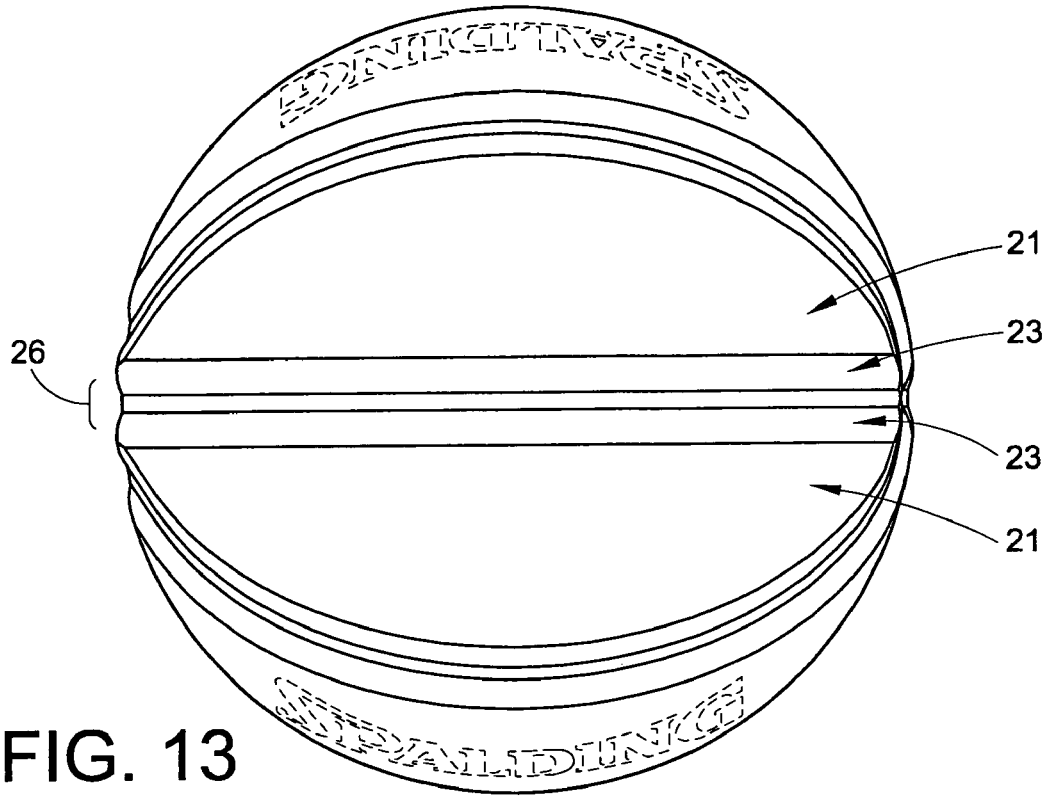
Figure 14:
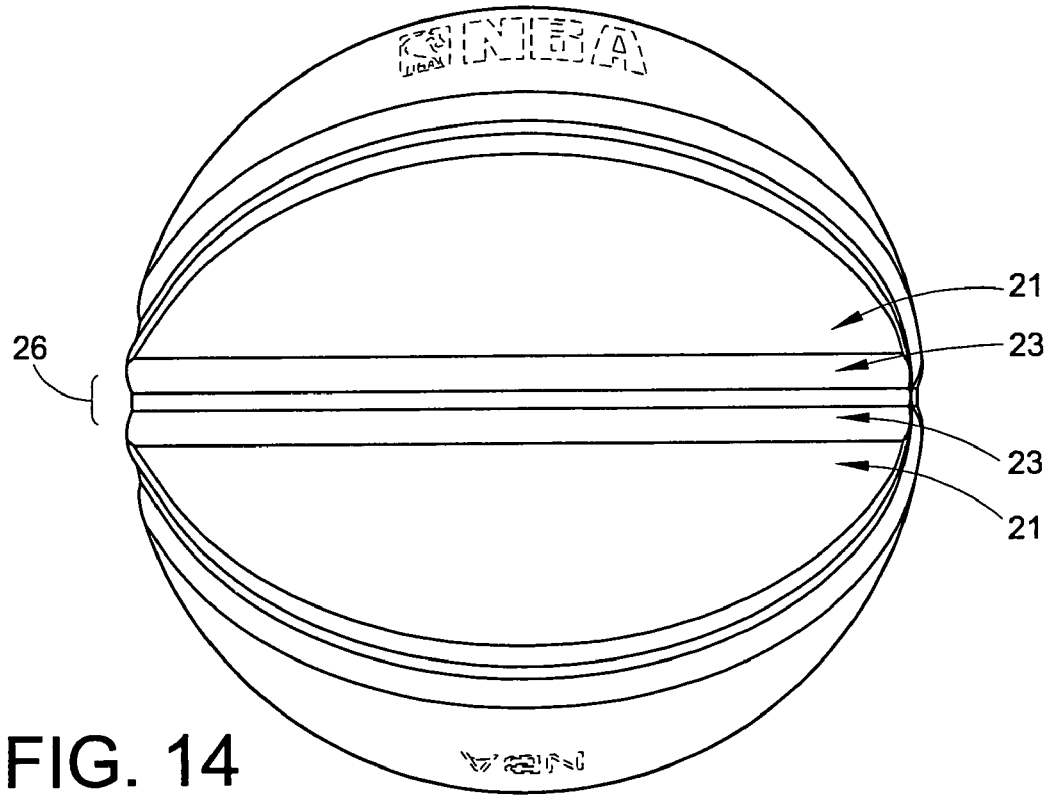

The exterior most cover of the basketball 10 is formed of discrete exterior panels 20 made from two or more materials having different characteristics, such as an inner panel portion 21 and outer panel portion 23. As shown in FIG. 3, the surface area for the inner panel portion 21 is larger than the surface area for the outer panel portion 23. The parts are joined together to form the desired designed configuration of the overall exterior panel 20. The panels 20 are then shaped, such as by being cut, to fit within the panel areas 18 between the ribs 26. Edge portions 52, 54 of the panels 20 can also be beveled or skived from a shoulder 60, 62 to form a panel edge 56, 58 respectively (see, for example, FIG. 2). The panel edges 56, 58, when laminated, will be adjacent a rib side 44, 46 and generally flush with the rib exterior face 42. A bonding agent, such as an adhesive, preferably a contact cement such as styrene butadiene, holds the panels 20 in place to the panel areas 18 of the carcass 16. Opposing panel shoulders 60, 62, panel edge portions 52, 54 and rib 26 define a panel seam or channel area.

Typically, the overall ball 10 comprises a total of eight (8) exterior cover panels 20 of somewhat similar leaf-shape configurations separated by the panel seam or channel areas. However, other arrangements are also contemplated herein. Optionally, the outer surfaces of the panels are also textured to produce a pebbled surface to produce a "leathered" appearance.

The panels 20 can be fabricated by joining together materials of different characteristics and/or compositions, in various sizes, shapes and configurations. For example, a die-cut machine can be used to form generally "segmented shaped" inner panel portions 21, and generally "linear shaped" outer panel portions 23 from the selected materials (see FIGS. 3-14. Each said inner panel portion 21 is connected at its edges to a said outer panel portion 23 at one of its edges. Additionally, each said outer panel portion 23 is connected at its opposite edge to the edge of a rib 26. As shown, the interior edge of the outer panel portion parallels the rib for substantially the entire length.

For example, the panels can be fabricated by utilizing inner and outer panel portions 21 and 23 comprised of various combinations of materials of different hardness/softness, tackiness, resilience, compression, moisture resistance, etc. characteristics which have been shaped and assembled to produce a desired design. An adhesive means, such as contact cement or glue can be applied to the backside of the materials, i.e., the inner panel portion 21 and the outer panel portion 23, and to the ribs 26. Said die-cut materials (inner and outer panel portions) can be applied to the ribs 26 using a hand-massaging technique or other methods to carefully bring the edges of said inner panel portions to meet the edges of said outer panel portions, and said opposite edges of outer panel portions to meet the ribs. This process can be utilized to construct a high quality basketball having outer panel portions with variable areas of hardness/softness, compression, moisture resistance, etc., thereby providing improvements in ball grip and handling characteristics among others.

It is important to note that the hand-massaging or other techniques used to join the inner and outer panel portions to the ribs ultimately forms the outside cover of the ball, giving the ball its generally round, but distinct appearance. Additionally, the different panel portions produce an outside cover exhibiting areas of non-uniform, variable, or different characteristics, such as tackiness, stiffness, etc. This results in a ball having, for example, not only improved grip and playability characteristics in certain areas, but also, in some instances, enhanced resilience, wear, durability, etc.

An example of an alternative possible construction of the ball includes rubber ribs 26 (natural or synthetic) extended into outer rubber panel portions 23 which are then connected to a PVC inner panel portion 21 to form the ball. Such a ball has enhanced feel or grip in the channel areas allowing the player to apply backspin to the ball when desired.

Additional possible, but non-limiting, combinations of materials which can be used on the inner and outer panel portions of the ball are set forth below:

| Outer Panel Portion | Inner Panel Portion |
|---|---|
| Rubber | PVC |
| Rubber | PU |
| Rubber | Synthetic Composite |
| Rubber | Microfiber Composite |
| PVC | Rubber |
| PVC | PU |
| PVC | Synthetic Composite |
| PVC | Microfiber Composite |
| PU | Rubber |
| PU | PVC |
| PU | Synthetic Composite |
| PU | Microfiber Composite |
| Synthetic Composite | Rubber |
| Synthetic Composite | PU |
| Synthetic Composite | PVC |
| Synthetic Composite | Microfiber Composite |
| Microfiber Composite | Rubber |
| Microfiber Composite | PVC |
| Microfiber Composite | PU |
| Microfiber Composite | Synthetic Composite |

It is important to note that any combination, variation or substitution of the above-referenced materials can be used to form the inner and outer panel portions 21 and 23. The outer panel portions 23 will ultimately be connected to said ribs 26, and also to said inner panel portions to form the cover of the ball. It is also important to note that alternative panel constructions are available and that the embodiments of the development described above are not limited to just the use of inner and outer panel portions. Intermediate and alternative panel portions, varying in characteristics, etc. also fall within the contemplated scope of this development. Moreover, similar materials varying in properties such as hardness/softness, compressibility, resilience, etc. can also be utilized. Such combinations will also produce an outer panel having multiple areas of variable characteristics.

It is further noted that during the manufacturing process of an additional embodiment, the die-cut shapes (i.e. the outer panel portions, inner panel portions, etc.) are about 1.5 mm to about 2.5 mm thick at the center. The outer panel portions are thinner than that near the edges thereof for joining to the ribs. This reduced thickness provides a recessed appearance in the ribbed areas of the ball, and to provide further improved grip and playability of the ball. A skiving or tapering process is used to achieve such reduced thickness on said edges of said outer panel portions.

Once the ribs are connected to the outer panel portions and/or the outer panel portions are connected to the inner panel portions to form the cover of the ball, the ball may be further optionally coated or treated (such as by decorating through the application of paint, decals, and other graphics or decorations) to produce an aesthetically pleasing look to the ball and/or to provide strength and durability.

Another valuable aspect of at least one embodiment of the present disclosure is to provide pebbling texture on the surface of each inner panel portion 21 and outer panel portion 23 allowing for improved grip and playability of the ball. (See FIGS. 3-14). The pebbling, such as molded-in pebble texture, simulates the texture of pebble grain leather and also provides for improved grip and handling of the ball.

For example, if the rubber rib is extended to a rubber outer panel portion and a PVC inner panel portion, the outer rubber panel portion can be pebbled. The inner PVC panel portion could also be pebbled; however, the edges of the inner PVC panel portion would be skived, and some of the pebbles on the PVC would have been thinned during the skiving process.

Therefore, the development also provides pebbling of greater thickness on the rubber (or other material) outer panel portion, in comparison to the pebbling on the PVC (or other material) inner panel portion.

It should also be noted that certain advantages exist when producing a ball using a combination of materials and/or materials having different properties in the panel portions, as suggested by the present disclosure. Such advantages would be, for example, to use PU on some of the panel portions of the ball to provide more grip, and to use PVC on other panel portions to reduce manufacturing expenses.

It should also be understood that it is possible to change the appearance of the ball by utilizing materials of different colors. For example, the inner and outer panels can be produced from different colored and textured materials. Moreover, the panels can be configured, molded, or engraved to include indicia, such as manufacturers' name, trademarks, molded numbers, inflation instructions, simulated lacing or stitching and graphics, on the surface panel of the ball.

It should also be understood that the design of the present development is most suitable, at the present time, for a basketball. However, it should further be noted that the above-described process and developments can also be used on various types of sportsballs, including for example footballs and soccer balls.

An alternative embodiment of the development disclosed herein is shown in FIGS. 11-14. In such embodiment, the rib 26 is extended into the normal panel area 18. This allows for the use of similar materials to form the ribs and channel areas. This also allows for the use of molded-in pebbling in the channel areas when the carcass is formed.

The balls of the present disclosure may be produced largely in a conventional manner. Accordingly, the air bladder 12 of the ball would be inflated to an appropriate size and preferably cooled to cause the material of the bladder to become somewhat rigid. In this rigid condition, the air bladder 12 is wound with adhesive coated polymer threads to produce the winding layer 14. The air bladder 12 with the overlying layer of windings 14 is then placed in a mold in which the carcass hemispheres are arrayed. The mold is closed and sealed and optionally the air bladder is inflated to help the bladder make full contact with the carcass materials within the mold, and heat and pressure are applied to cause the rubber of the carcass to cure and vulcanize and become securely attached to the air bladder 12 and winding layer 14. The molding process further forms the structure of the carcass 16, including ribs 26 and panel areas 18.

Individual panels 20 are formed to fit over the surface of the carcass within the panel areas 18 defined by the formed ribs 26. The edge portion 52, 54 of each panel is skived or tapered. When a skived panel edge 58 is correctly positioned abutting a rib 26, the panel edge will be adjacent a rib side and substantially flush with the outwardly projecting rib face 42.

In the case of a ball with a cellular carcass portion or layer, the cells are typically produced by adding a blowing agent to the raw material. Different concentrations of blowing agent will change the density of the molded cellular layer. Such blowing agents are exemplified by Celogen TSH available, from Uniroyal Chemical, Middlebury, Conn. USA. The cellular layer is typically formed around the substructure formed by the air bladder 12 and the winding layer 14 in a molding process, wherein the bladder/winding substructure is placed in a mold and the cellular layer material in a non-expanded state is molded around the substructure. The heat of the molding operation causes the blowing agent to expand. The end result of the molding operation is a unitary structure with a cured, cellular layer of a desired density molded over the winding layer. The thickness of the cellular layer is governed by the space between the bladder/winding substructure outer diameter and the mold inner diameter. The structure thus formed is placed in a second mold and the carcass hemispheres are molded over the cellular layer.

Subsequently, the completed ball is taken from the mold and flash from the molding process is trimmed from the ball. The ball is then in condition for the application of decals, paint or other decorative or informative markings. The balls described above have preferably the same weight, circumference, and diameter of a "regulation" (size 7) basketball. However, balls of other sizes (i.e., intermediate (size 6), youth (size 5), etc) and weight are also contemplated by this development. The balls may also be utilized for indoor and outdoor play.

As will be apparent to persons skilled in the art, various modifications and adaptations of the structure described above will become readily apparent without departure of the spirit and scope of the development disclosed herein. The above description merely provides a disclosure of particular embodiments of the development and is not intended for the purposes of limiting the same thereto. Rather, it is recognized that one skilled in the art could conceive alternative embodiments that fall within the scope of the development.

What is claimed is:

1. A sportsball, comprising:

an inflatable bladder;

a winding thread layer surrounding said bladder;

a carcass having an inner face adjacent said winding thread layer and an outer face, said outer face consisting of a plurality of curvilinearly extending ribs each having sides and an exteriorly projecting face, said ribs defining a plurality of separated panel areas; and a plurality of external cover panels, each affixed to the outer face of said carcass in one of said separated panel areas defined by the ribs, wherein each external cover panel comprises an outer panel portion and an inner panel portion, the outer panel portion having an interior edge and an exterior edge, the inner panel portion having at least one edge which is connected to the interior edge of the outer panel portion, and the exterior edge of the outer panel portion being connected to the ribs;

wherein the outer panel portion and inner panel portion comprise materials having different characteristics, the inner and outer panel portions are each visible when the external cover panel is affixed to the outer face; and wherein the interior edge of the outer panel portion parallels the ribs to which the exterior edge is connected for substantially the entire length of the rib that defines the respective panel area.

2. The sportsball of claim 1, wherein the inner and outer panel portions are different from each other and comprise a material selected from the group consisting of polyvinyl chloride, polyurethane, rubber, leather, micro-fiber composite or synthetic composite materials.

3. The sportsball of claim 2, wherein the leather is synthetic.

4. The sportsball of claim 2, wherein the leather is natural.

5. The sportsball of claim 2, wherein the rubber is synthetic.

6. The sportsball of claim 2, wherein the rubber is natural.

7. The sportsball of claim 1, wherein the materials of the inner and outer panels portions differ in one or more characteristics selected from the group consisting of hardness/softness, tensile strength, tackiness, elongation, slip resistance, compression and resilience.

8. The sportsball of claim 1, wherein the materials of the inner and outer panels portions differ in one or more characteristics selected from the group consisting of abrasion resistance, scuff, or durability.

9. The sportsball of claim 1, wherein said carcass further comprises a cellular material.

10. The sportsball of claim 1, wherein the composition of the ribs and the outer panel portion are similar.

11. A basketball comprising:

a carcass having an outer face consisting of a plurality of curvilinearly extending ribs defining a plurality of separated panel areas and an exteriorly projecting face; and a plurality of external cover panels, each affixed to the separated panel areas, wherein at least one external cover panel comprises an outer panel portion and an inner panel portion, the outer panel portion having an interior edge and an exterior edge, the inner panel portion having at least one edge which is connected to the interior edge of the outer panel portion, and the exterior edge of the outer panel portion being connected to a rib;

wherein the outer panel portion and inner panel portion comprise materials having different characteristics, the inner and outer panel portions are each visible when the external cover panel is affixed to the outer face;

wherein the interior edge of the outer panel portion parallels the ribs to which the exterior edge is connected for substantially the entire length of the rib that defines the respective panel area.

12. The basketball of claim 11, wherein the materials of the inner and outer panel portions are selected from the group consisting of polyvinyl chloride, polyurethane, rubber, leather, micro-fiber composite or synthetic composite materials.

13. The basketball of claim 11, wherein two or more of the external cover panels comprise inner and outer panel portions.

14. The basketball of claim 11, wherein four or more of the external cover panels comprise inner and outer panel portions.

15. The basketball of claim 11, wherein the external cover panel comprises a total of three or more panel portions, each panel portion having different characteristics.

16. The basketball of claim 11, wherein of the external cover panel comprises a total of four or more panel portions, each panel portion having different characteristics.

17. A basketball comprising:

a carcass having an outer face consisting of a plurality of curvilinearly extending ribs defining a plurality of separated panel areas and an exteriorly projecting face; and a plurality of external cover panels, each affixed to the separated panel areas, wherein at least one external cover panel comprises an outer panel portion and an inner panel portion, the outer panel portion having an interior edge and an exterior edge, the inner panel portion exterior edge being connected to the interior edge of the outer panel portion, and the exterior edge of the outer panel portion being connected to a rib;

wherein the outer panel portion and inner panel portion comprise materials having different characteristics, the inner and outer panel portions are each visible when the external cover panel is affixed to the outer face;

wherein the interior edge of the outer panel portion parallels the ribs to which the exterior edge is connected and the surface area of the inner panel portion is larger than the surface area of the outer panel portion.

* * * * *